US006962216B2

(12) United States Patent
Zupanick

(10) Patent No.: US 6,962,216 B2
(45) Date of Patent: Nov. 8, 2005

(54) WEDGE ACTIVATED UNDERREAMER

(75) Inventor: Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 94 days.

(21) Appl. No.: 10/160,425

(22) Filed: May 31, 2002

(65) Prior Publication Data

US 2004/0084183 A1 May 6, 2004

(51) Int. Cl.[7] ..... E21B 10/32
(52) U.S. Cl. ..... 175/263; 166/267
(58) Field of Search ..... 175/53, 57, 263, 175/267, 406

(56) References Cited

U.S. PATENT DOCUMENTS

| | | | | |
|---|---|---|---|---|
| 54,144 | A | 4/1866 | Hamar | 175/263 |
| 130,442 | A | 8/1872 | Russell | |
| 274,740 | A | 3/1883 | Douglass | |
| 526,708 | A | 10/1894 | Horton | |
| 639,036 | A | 12/1899 | Heald | 175/263 |
| 1,189,560 | A | 7/1916 | Gondos | 175/265 |
| 1,230,666 | A | 6/1917 | Carden | |
| 1,285,347 | A | 11/1918 | Otto | 175/263 |
| 1,317,192 | A | 9/1919 | Jones | |
| 1,467,480 | A | 9/1923 | Hogue | 175/263 |
| 1,485,615 | A | 3/1924 | Jones | 175/263 |
| 1,498,463 | A | 6/1924 | McCloskey et al. | |
| 1,589,508 | A | 6/1926 | Boynton | |
| 1,674,392 | A | 6/1928 | Flansburg | |
| 1,710,998 | A | 4/1929 | Rudkin | |

(Continued)

FOREIGN PATENT DOCUMENTS

| | | | |
|---|---|---|---|
| CA | 1067819 | 12/1979 | E21B/43/25 |
| DE | 1 207 907 | 12/1965 | |
| EP | 0 300 627 A1 | 1/1989 | |
| WO | WO 01/83932 A1 | 11/2001 | E21B/7/20 |

OTHER PUBLICATIONS

Notification of Transmittal of the International Search Report or the Declaration (PCT Rule 44.1) mailed Jul. 4, 2003 (10 pages) re International Application No. PCT/US 03/04771.

Notification of Transmittal of the International Search Report or the Declaration (PCT Rule 44.1) mailed Sep. 2, 2003 (8 pages) re International Application No. PCT/US 03/14828.

(Continued)

*Primary Examiner*—David Bagnell
*Assistant Examiner*—Daniel Stephenson
(74) *Attorney, Agent, or Firm*—Fish & Richardson P.C.

(57) ABSTRACT

An underreamer for forming a cavity from within a well bore includes a housing adapted to be disposed within the well bore. The underreamer includes at least one cutter, wherein each cutter has a first end and a second end. The first end of each cutter is pivotally coupled to the housing. The underreamer also includes an actuator slidably positioned in the housing, wherein the actuator has a first end and a second end. The underreamer includes an enlarged portion of the actuator proximate the second end of the actuator. A first axial force applied to the actuator is operable to slide the actuator relative to the housing causing the enlarged portion to contact each cutter and extend the second end of each cutter radially outward relative to the housing from a retracted position to a first position. A second axial force applied to the underreamer may be operable to further extend the second end of each cutter radially outward relative to the housing from the first position to a second position.

22 Claims, 5 Drawing Sheets

U.S. PATENT DOCUMENTS

| | | | | |
|---|---|---|---|---|
| 1,970,063 | A | 8/1934 | Steinman | 255/74 |
| 2,018,285 | A | 10/1935 | Schweitzer et al. | 166/21 |
| 2,031,353 | A | 2/1936 | Woodruff | 255/76 |
| 2,033,521 | A | 3/1936 | Horn | |
| 2,069,482 | A | 2/1937 | Seay | 255/76 |
| 2,150,228 | A | 3/1939 | Lamb | 166/10 |
| 2,169,502 | A | 8/1939 | Santiago | 255/76 |
| 2,169,718 | A | 8/1939 | Böll et al. | 255/24 |
| 2,203,998 | A | 6/1940 | O'Grady | |
| 2,290,502 | A | 7/1942 | Squires | 255/76 |
| 2,450,223 | A | 9/1948 | Barbour | 255/76 |
| 2,490,350 | A | 12/1949 | Grable | 166/4 |
| 2,679,903 | A | 6/1954 | McGowen, Jr. et al. | 166/1 |
| 2,814,463 | A | 11/1957 | Kammerer, Jr. | |
| 2,847,189 | A | 8/1958 | Shook | 255/76 |
| 3,087,552 | A | 4/1963 | Graham | |
| 3,107,731 | A | 10/1963 | Dinning | |
| 3,126,065 | A | 3/1964 | Chadderdon | |
| 3,196,961 | A | 7/1965 | Kammerer | |
| 3,236,320 | A | 2/1966 | Russ | |
| 3,339,647 | A | 9/1967 | Kammerer, Jr. | 175/268 |
| 3,379,266 | A | 4/1968 | Fletcher | 175/285 |
| 3,397,750 | A | 8/1968 | Wicklund | 175/18 |
| 3,443,648 | A | 5/1969 | Howard | 175/103 |
| 3,528,516 | A | 9/1970 | Brown | 175/267 |
| 3,530,675 | A | 9/1970 | Turzillo | |
| 3,552,509 | A | 1/1971 | Brown | |
| 3,554,304 | A | 1/1971 | Link et al. | |
| 3,598,193 | A | 8/1971 | Hilton | |
| 3,656,564 | A | 4/1972 | Brown | |
| 3,684,041 | A | 8/1972 | Kammerer, Jr. et al. | 175/267 |
| 3,731,753 | A | 5/1973 | Weber | |
| 3,757,876 | A | 9/1973 | Pereau | 175/267 |
| 3,757,877 | A | 9/1973 | Leathers | 175/269 |
| 4,073,351 | A | 2/1978 | Baum | 175/14 |
| 4,116,012 | A | 9/1978 | Abe et al. | |
| 4,151,880 | A | 5/1979 | Vann | 166/314 |
| 4,158,388 | A | 6/1979 | Owen et al. | 166/286 |
| 4,169,510 | A | 10/1979 | Meigs | 175/65 |
| 4,189,184 | A | 2/1980 | Green | 299/8 |
| 4,243,099 | A | 1/1981 | Rodgers, Jr. | 166/65 R |
| 4,278,137 | A | 7/1981 | Van Eek | 175/267 |
| 4,323,129 | A | 4/1982 | Cordes | 175/285 |
| 4,366,988 | A | 1/1983 | Bodine | 299/14 |
| 4,396,076 | A | 8/1983 | Inoue | 175/265 |
| 4,401,171 | A | 8/1983 | Fuchs | 175/267 |
| 4,407,376 | A | 10/1983 | Inoue | 175/267 |
| 4,494,616 | A | 1/1985 | McKee | 175/67 |
| 4,549,630 | A | 10/1985 | Brown | 181/106 |
| 4,558,744 | A | 12/1985 | Gibb | 166/335 |
| 4,565,252 | A | 1/1986 | Campbell et al. | 175/269 |
| 4,618,009 | A | 10/1986 | Carter et al. | 175/267 |
| 4,674,579 | A | 6/1987 | Geller et al. | 175/45 |
| 4,715,440 | A | 12/1987 | Boxell et al. | 166/100 |
| 4,830,105 | A | 5/1989 | Petermann | 166/241 |
| 4,887,668 | A | 12/1989 | Lynde et al. | 166/55.8 |
| 5,009,273 | A | 4/1991 | Grabinski | |
| 5,036,921 | A | 8/1991 | Pittard et al. | 166/298 |
| 5,074,366 | A | 12/1991 | Karlsson et al. | |
| 5,111,893 | A | 5/1992 | Kvello-Aune | |
| 5,135,058 | A | 8/1992 | Millgard et al. | 175/71 |
| 5,148,875 | A | 9/1992 | Karlsson et al. | 175/62 |
| 5,168,942 | A | 12/1992 | Wydrinski | |
| 5,174,374 | A | 12/1992 | Hailey | |
| 5,197,553 | A * | 3/1993 | Leturno | 175/57 |
| 5,201,817 | A | 4/1993 | Hailey | 175/269 |
| 5,242,017 | A | 9/1993 | Hailey | 166/55.8 |
| 5,255,741 | A | 10/1993 | Alexander | 166/278 |
| 5,271,472 | A | 12/1993 | Leturno | 175/107 |
| 5,348,091 | A | 9/1994 | Tchakarov et al. | 166/217 |
| 5,363,927 | A | 11/1994 | Frank | 175/67 |
| 5,385,205 | A | 1/1995 | Hailey | 166/55.8 |
| 5,392,862 | A | 2/1995 | Swearingen | 166/386 |
| 5,402,856 | A | 4/1995 | Warren et al. | 175/57 |
| 5,413,183 | A * | 5/1995 | England | 175/53 |
| 5,494,121 | A | 2/1996 | Nackerud | 175/263 |
| 5,499,687 | A | 3/1996 | Lee | 175/317 |
| 5,722,489 | A | 3/1998 | Lambe et al. | 166/269 |
| 5,853,054 | A | 12/1998 | McGarian et al. | 175/267 |
| 6,070,677 | A | 6/2000 | Johnston, Jr. | 175/57 |
| 6,082,461 | A | 7/2000 | Newman et al. | 166/381 |
| 6,217,260 | B1 | 4/2001 | He | 405/237 |
| 6,227,312 | B1 | 5/2001 | Eppink et al. | 175/57 |
| 6,378,626 | B1 | 4/2002 | Wallace | 175/19 |
| 6,412,556 | B1 | 7/2002 | Zupanick | 166/255.2 |
| 6,454,000 | B1 | 9/2002 | Zupanick | 166/243 |
| 6,454,024 | B1 | 9/2002 | Nackerud | |
| 6,494,272 | B1 * | 12/2002 | Eppink et al. | 175/57 |
| 6,644,422 | B1 | 11/2003 | Rial | 175/57 |
| 2002/0070052 | A1 | 6/2002 | Armell et al. | 175/273 |
| 2004/0011560 | A1 | 1/2004 | Rial et al. | |

OTHER PUBLICATIONS

Nackerud Product Description, Rec'd Sep. 27, 2001.

Pend Pat App, Monty H. Rial et al., "*Pantograph Underreamer,*" SN 09/929,568 (067083.0145), Filed Aug. 13, 2001.

Pend Pat App, Monty H. Rial et al., "*Pantograph Underreamer,*" SN 09/929,551 (067083.0126), Filed Aug. 13, 2001.

Pend Pat App, Monty H. Rial et al., "*Pantograph Underreamer,*" SN 09/929,175 (067083.0142), Filed Aug. 13, 2001.

Pend Pat App, Lawrence W. Diamond et al., "*Single–BladeUnderreamer,*" SN 09/932,482 (067083.0125), Filed Aug. 17, 2001.

Pend Pat App, Lawrence W. Diamond et al., "*Multi–Blade-Underreamer,*" SN 09/932,487 (067083.0136, Filed Aug. 17, 2001.

Pend Pat App, Monty H. Rial et al., "*Pantograph Underreamer,*" SN 10/079,444 (067083.0143), Filed Feb. 19, 2001.

Notification of Transmittal of the International Search Report or the Declaration (PCT Rule 44.1) mailed Nov. 13, 2003 (8 pages) re International Application No. PCT/US 03/21891.

Zupanick et al., U.S. Appl. No. 10/188,159, "Cavity Positioning Tool and Method," filed Jul. 1, 2003 (28 pages).

Zupanick et al., U.S. Appl. No. 10/419,529, "Slot Cavity," filed Apr. 21, 2003 (43 pages).

Zupanic, et al., U.S. Appl. No. 10/687,362, "Cavity Positioning Tool and Method," filed Oct. 14, 2003 (27 pages).

E–Tronics, ABI Oil Tools, Tubing Rotator Operating Effectiveness, Jun. 2002 (1 page).

* cited by examiner

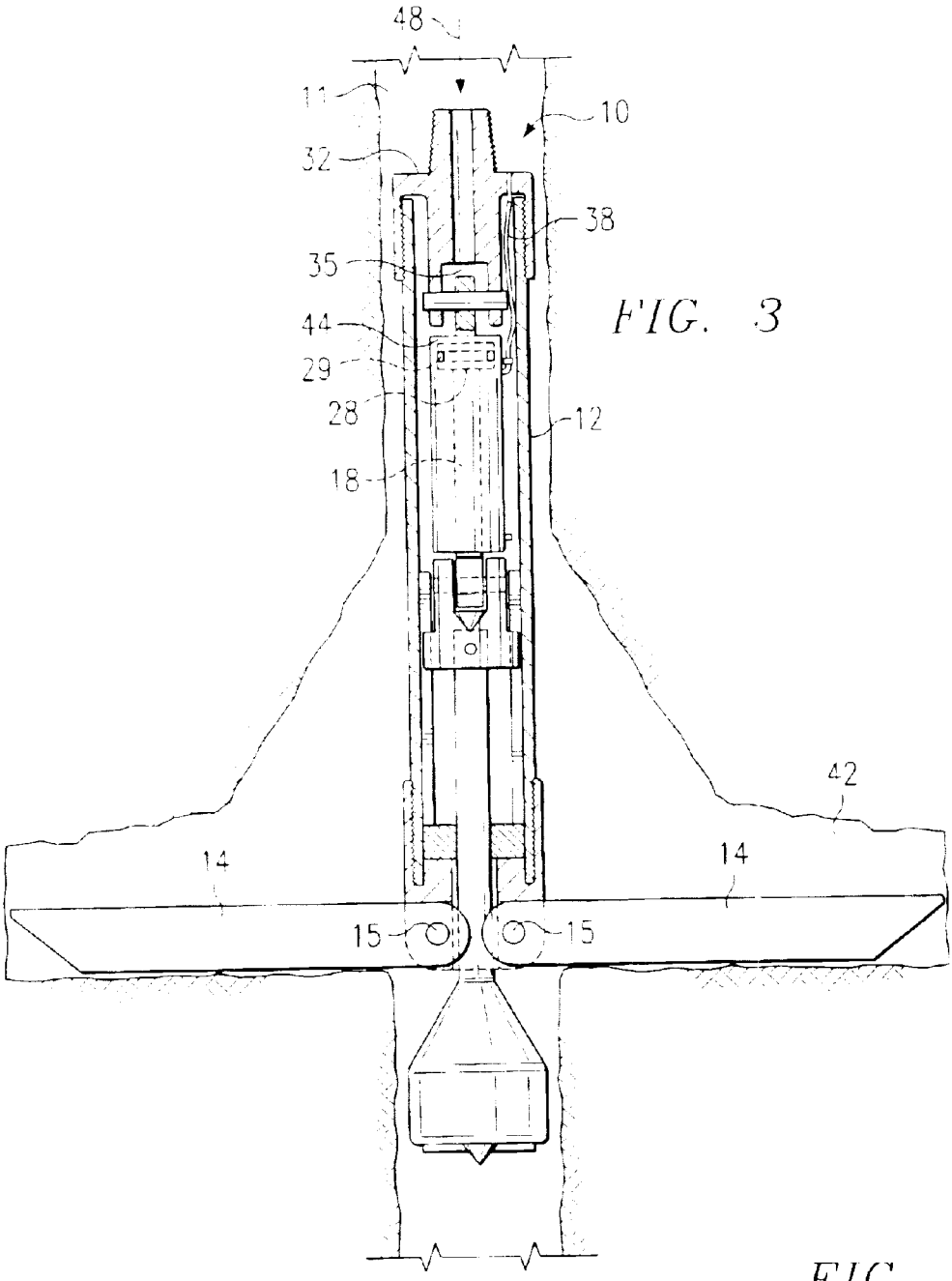
FIG. 3
FIG. 4
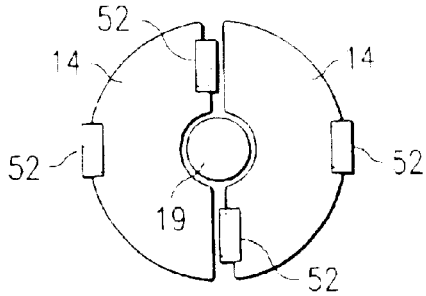

WEDGE ACTIVATED UNDERREAMER

TECHNICAL FIELD OF THE INVENTION

This invention relates in general to the field of subterranean exploration and, more particularly, to a wedge activated underreamer.

BACKGROUND OF THE INVENTION

Underreamers may be used to form an enlarged cavity in a well bore extending through a subterranean formation. The cavity may then be used to collect resources for transport to the surface, as a sump for the collection of well bore formation cuttings and the like or for other suitable subterranean exploration and resource production operations. Additionally, the cavity may be used in well bore drilling operations to provide an enlarged target for constructing multiple intersecting well bores.

One example of an underreamer includes a plurality of cutting blades pivotally coupled to a lower end of a drill pipe. Centrifugal forces caused by rotation of the drill pipe extends the cutting blades outwardly and diametrically opposed to each other. As the cutting blades extend outwardly, the centrifugal forces cause the cutting blades to contact the surrounding formation and cut through the formation. The drill pipe may be rotated until the cutting blades are disposed in a position substantially perpendicular to the drill pipe, at which time the drill pipe may be raised and/or lowered within the formation to form a cylindrical cavity within the formation.

Conventional underreamers, however, suffer several disadvantages. For example, the underreamer described above generally requires high rotational speeds to produce an adequate level of centrifugal force to cause the cutting blades to cut into the formation. An equipment failure occurring during high speed rotation of the above-described underreamer may cause serious harm to operators of the underreamer as well as damage and/or destruction of additional drilling equipment.

Additionally, density variations in the subsurface formation may cause each of the cutting blades to extend outwardly at different rates and/or different positions relative to the drill pipe. The varied positions of the cutting blades relative to the drill pipe may cause an out-of-balance condition of the underreamer, thereby creating undesired vibration and rotational characteristics during cavity formation, as well as an increased likelihood of equipment failure.

SUMMARY OF THE INVENTION

The present invention provides a wedge activated underreamer that substantially eliminates or reduces at least some of the disadvantages and problems associated with previous underreaming tools.

In accordance with a particular embodiment of the present invention, an underreamer for forming a cavity from within a well bore includes a housing adapted to be disposed within the well bore. The underreamer includes at least one cutter, wherein each cutter has a first end and a second end. The first end of each cutter is pivotally coupled to the housing. The underreamer also includes an actuator slidably positioned in the housing, wherein the actuator has a first end and a second end. The underreamer includes an enlarged portion of the actuator proximate the second end of the actuator. A first axial force applied to the actuator is operable to slide the actuator relative to the housing causing the enlarged portion to contact each cutter and extend the second end of each cutter radially outward relative to the housing from a retracted position to a first position. A second axial force applied to the underreamer may be operable to further extend the second end of each cutter radially outward relative to the housing from the first position to a second position.

In accordance with another embodiment, a method for forming a cavity from within a well bore includes providing an underreamer within the well bore. The underreamer has a housing and an actuator. The actuator has a first end and a second end and an enlarged portion proximate the second end. The actuator is slidably positioned in the housing. The underreamer has at least one cutter, wherein each cutter has a first end and a second end. The first end of each cutter is pivotally coupled to the housing. The method includes applying a first axial force to the actuator, causing the enlarged portion to contact each cutter. The method also includes extending each cutter radially outward relative to the housing from a retracted position to a first position to form the cavity. The extension is in response to the contact of each cutter by the enlarged portion and movement of the actuator from the applied first axial force. The method may also include applying a second axial force to the underreamer to cause each cutter to contact a surface of the well bore and further extend the second end of each cutter radially outward relative to the housing from the first position to a second position.

Particular embodiments of the present invention include a number of technical advantages. Some embodiments include an underreamer in which an axial force is applied to an actuator having an enlarged portion to extend cutters as the enlarged portion contacts the cutters and the actuator moves relative to the housing. Accordingly, little or no rotation of the housing may be required to extend the cutters, thereby substantially reducing or eliminating hazards associated with high speed rotating mechanisms.

Particular embodiments of the present invention substantially reduce or eliminate out-of-balance conditions resulting from extension of cutters within a well bore. For example, according to certain embodiments of the present invention, an enlarged portion of an actuator forces each cutter radially outward relative to the underreamer housing as the enlarged portion moves relative to the housing, thereby resulting in substantially uniform extension of each cutter relative to the housing. Accordingly, occurrences of out-of-balance conditions caused by varying positions of cutters are substantially reduced or eliminated.

Other technical advantages will be readily apparent to one skilled in the art from the figures, descriptions and claims included herein. Moreover, while specific advantages have been enumerated above, various embodiments may include all, some or none of the enumerated advantages.

BRIEF DESCRIPTION OF THE DRAWINGS

For a more complete understanding of particular embodiments of the invention and their advantages, reference is now made to the following descriptions, taken in conjunction with the accompanying drawings, in which:

FIG. 3 is a diagram illustrating the underreamer of FIG. 1 in an extended position;

FIG. 4 is a cross-sectional view of FIG. 1 taken along line 4—4, illustrating the cutters of the example underreamer of FIG. 1;

DETAILED DESCRIPTION OF THE INVENTION

Figure 1:
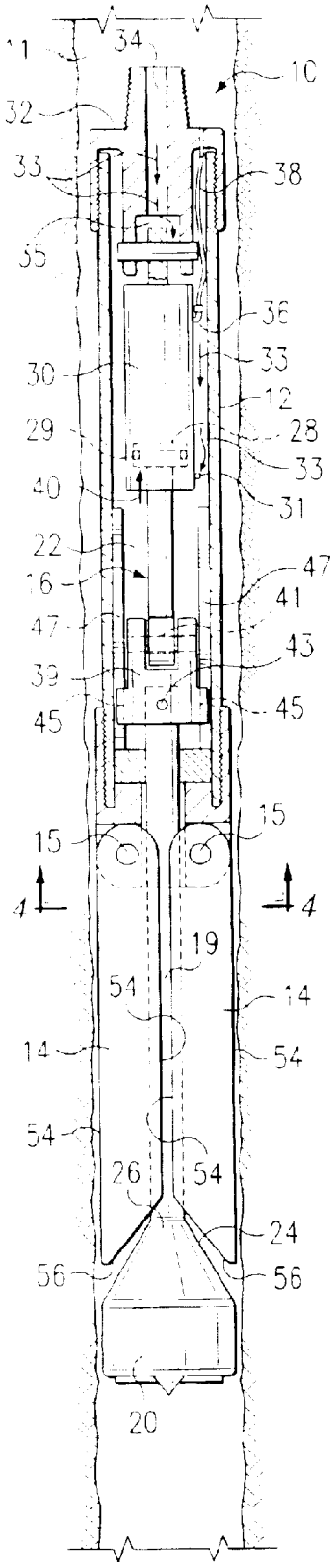
FIG. 1 is a diagram illustrating an underreamer in accordance with an embodiment of the present invention.

FIG. 1 is a diagram illustrating a wedge-activated underreamer in accordance with an embodiment of the present invention. Underreamer 10 includes a housing 12 illustrated as being substantially vertically disposed within a well bore 11. However, it should be understood that underreamer 10 may also be used in non-vertical cavity forming operations.

Underreamer 10 includes an actuator 16 with a portion slidably positioned within a pressure cavity 22 of housing 12. Actuator 16 includes a piston 18, a connector 39, a rod 19 and an enlarged portion 20. Piston is coupled to connector 39 using a pin 41. Connector 39 is coupled to rod 19 using a pin 43. Piston 18 has an enlarged first end 28 located within a hydraulic cylinder 30 of housing 12. Hydraulic cylinder 30 includes an inlet 31 which allows a pressurized fluid to enter hydraulic cylinder 30 from pressure cavity 22. Hydraulic cylinder 30 also includes an outlet 36 which is coupled to a vent hose 38 to provide an exit for the pressurized fluid from hydraulic cylinder 30. Enlarged portion 20 is at an end 26 of rod 19. Wedge activation of underreamer 10 is performed by enlarged portion 20. In this embodiment, enlarged portion 20 includes a beveled portion 24. However, in other embodiments, enlarged portion may comprise other angles, shapes or configurations, such as a cubical, spherical, conical or teardrop shape.

Underreamer 10 also includes cutters 14 pivotally coupled to housing 12. In this embodiment, each cutter 14 is pivotally coupled to housing 12 via a pin 15; however, other suitable methods may be used to provide pivotal or rotational movement of cutters 14 relative to housing 12. Cutters 14 are illustrated in a retracted position, nesting around a rod 19 of actuator 16. Cutters 14 may have a length of approximately two to three feet; however, the length of cutters 14 may be different in other embodiments. The illustrated embodiment shows an underreamer having two cutters 14; however, other embodiments may include an underreamer having one or more than two cutters 14. Cutters 14 are illustrated as having angled ends; however, the ends of cutters 14 in other embodiments may not be angled or they may be curved, depending on the shape and configuration of enlarged portion 20.

In the embodiment illustrated in FIG. 1, cutters 14 comprise side cutting surfaces 54 and end cutting surfaces 56. Cutters 14 may also include tips which may be replaceable in particular embodiments as the tips get worn down during operation. In such cases, the tips may include end cutting surfaces 56. Cutting surfaces 54 and 56 and the tips may be dressed with a variety of different cutting materials, including, but not limited to, polycrystalline diamonds, tungsten carbide inserts, crushed tungsten carbide, hard facing with tube barium, or other suitable cutting structures and materials, to accommodate a particular subsurface formation. Additionally, various cutting surfaces 54 and 56 configurations may be machined or formed on cutters 14 to enhance the cutting characteristics of cutters 14.

Housing 12 is threadably coupled to a drill pipe connector 32 in this embodiment; however other suitable methods may be used to couple drill pipe connector 32 to housing 12. Drill pipe connector 32 may be coupled to a drill string that leads up well bore 11 to the surface. Drill pipe connector 32 includes a fluid passage 34 with an end 35 which opens into pressure cavity 22 of housing 12.

In operation, a pressurized fluid is passed through fluid passage 34 of drill pipe connector 32. The fluid may be pumped down a drill string and drill pipe connector 32. In particular embodiments, the pressurized fluid may have a pressure of approximately 500–600 psi; however, any appropriate pressure may be used. The pressurized fluid passes through fluid passage 34 to cavity 22 of housing 12. A nozzle or other mechanism may control the flow of the fluid into cavity 22. The pressurized fluid flows through cavity 22 and enters hydraulic cylinder 30 through inlet 31. The fluid may flow as illustrated by arrows 33. Other embodiments of the present invention may include more than one inlet 31 into hydraulic cylinder 30 or may provide other ways for the pressurized fluid to enter hydraulic cylinder 30. Inside hydraulic cylinder 30, the pressurized fluid exerts a first axial force 40 upon first end 28 of piston 18, thereby causing movement of piston 18 relative to housing 12. Gaskets 29 may encircle enlarged first end 28 to prevent the pressurized fluid from flowing around first end 28.

The movement of piston 18 causes enlarged portion 20 to move relative to housing 12, since enlarged portion 20 is coupled to piston 18. As enlarged portion 20 moves, beveled portion 24 comes into contact with cutters 14. Beveled portion 24 forces cutters 14 to rotate about pins 15 and extend radially outward relative to housing 12 as enlarged portion 20 moves relative to housing 12. Through the extension of cutters 14 via the movement of piston 18 and enlarged portion 20 relative to housing 12, underreamer 10 forms an enlarged well bore diameter as cutting surfaces 54 and 56 come into contact with the surfaces of well bore 11.

Connector 39 includes grooves 45 which slide along guide rails 47 when actuator 16 moves relative to housing 12. This prevents actuator 16 from rotating with respect to housing 12 during such movement.

Housing 12 may be rotated within well bore 11 as cutters 14 extend radially outward to aid in forming cavity 42. Rotation of housing 12 may be achieved using a drill string coupled to drill pipe connector 32; however, other suitable methods of rotating housing 12 may be utilized. For example, a downhole motor in well bore 11 may be used to rotate housing 12. In particular embodiments, both a downhole motor and a drill string may be used to rotate housing 12. The drill string may also aid in stabilizing housing 12 in well bore 11.

Figure 2:
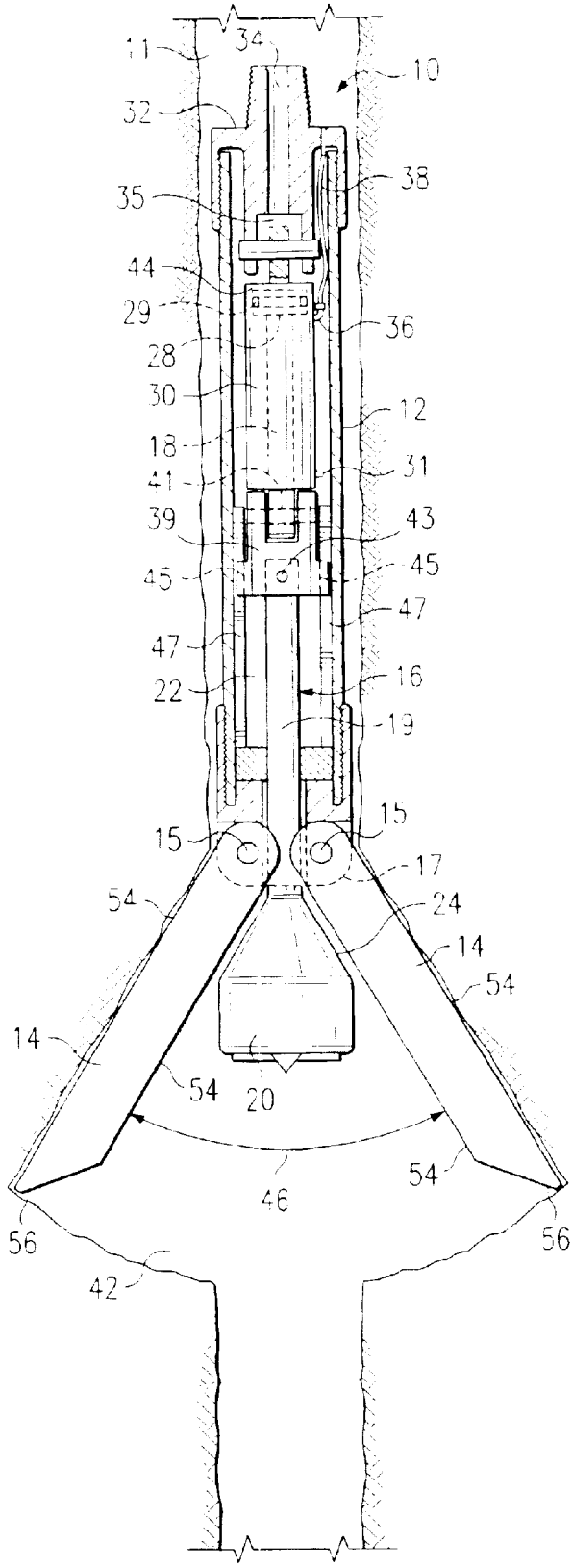
FIG. 2 is a diagram illustrating the underreamer of FIG. 1 in a semi-extended position.

FIG. 2 is a diagram illustrating underreamer 10 of FIG. 1 in a semi-extended position. In FIG. 2, cutters 14 are in a semi-extended position relative to housing 12 and have begun to form an enlarged cavity 42. When first axial force 40 (illustrated in FIG. 1) is applied and piston 18 moves relative to housing 12, first end 28 of piston 18 will eventually reach an end 44 of hydraulic cylinder 30. At this point, enlarged portion 20 is proximate an end 17 of housing 12. Cutters 14 are extended as illustrated and an angle 46 will be formed between them. In this embodiment, angle 46 is approximately sixty degrees, but angle 46 may be different in other embodiments depending on the angle of beveled portion 24 or the shape or configuration of enlarged portion 20. As first end 28 of piston 18 moves towards end 44 of hydraulic cylinder 30, the fluid within hydraulic cylinder 30 may exit hydraulic cylinder 30 through outlet 36. The fluid may exhaust to the well bore through vent hose 38. Other embodiments of the present invention may include more than one outlet 36 or may provide other ways for the pressurized fluid to exit hydraulic cylinder 30.

FIG. 3 is a diagram illustrating underreamer 10 of FIG. 1 in an extended position. Once enough first axial force 40 has been exerted on first end 28 of piston 18 for first end 28 to contact end 44 of hydraulic cylinder 30 thereby extending cutters 14 to a semi-extended position as illustrated in FIG. 2, a second axial force 48 may be applied to underreamer 10. Second axial force 48 may be applied by moving underreamer 10 relative to well bore 11. Such movement may be accomplished by moving the drill string coupled to drill pipe connector 32 or by any other technique. The application of second axial force 48 forces cutters to rotate about pins 15 and further extend radially outward relative to housing 12. The application of second axial force 48 may further extend cutters 14 to position where they are approximately perpendicular to a longitudinal axis if housing 12, as illustrated in FIG. 3. Housing 12 may include a bevel or "stop" in order to prevent cutters 14 from rotating passed a particular position, such as an approximately perpendicular position to a longitudinal axis of housing 12 as illustrated in FIG. 3.

Underreamer 10 may be raised and lowered within well bore 11 without rotation to further define and shape cavity 42. Such movement may be accomplished by raising and lowering the drill string coupled to drill pipe connector 32. Housing 12 may also be partially rotated to further define and shape cavity 42. It should be understood that a subterranean cavity having a shape other than the shape of cavity 42 may be formed with underreamer 10.

Various techniques may be used to actuate the cutters of underreamers in accordance with embodiments of the present invention. For example, some embodiments may not include the use of a piston to actuate the cutters. For example, a fishing neck may be coupled to an end of the actuator. An upward axial force may be applied to the fishing neck using a fishing tool in order to move enlarged portion 120 relative to the housing to extend the cutters.

FIG. 4 is a cross-sectional view of FIG. 1 taken along line 4—4, illustrating the nesting of cutters 14 around rod 19 while cutters 14 are in a retracted position, as illustrated in FIG. 1. Cutters 14 may include cutouts 50 which may be filled with various cutting materials such as a carbide matrix 52 as illustrated to enhance cutting performance. It should be understood that nesting configurations other than the configuration illustrated in FIG. 4 may be used. Furthermore, cutters 14 may have various other cross-sectional configurations other than the configurations illustrated, and such cross-sectional configurations may differ at different locations on cutters 14. For example, in particular embodiments, cutters 14 may not be nested around rod 19.

Figure 5:
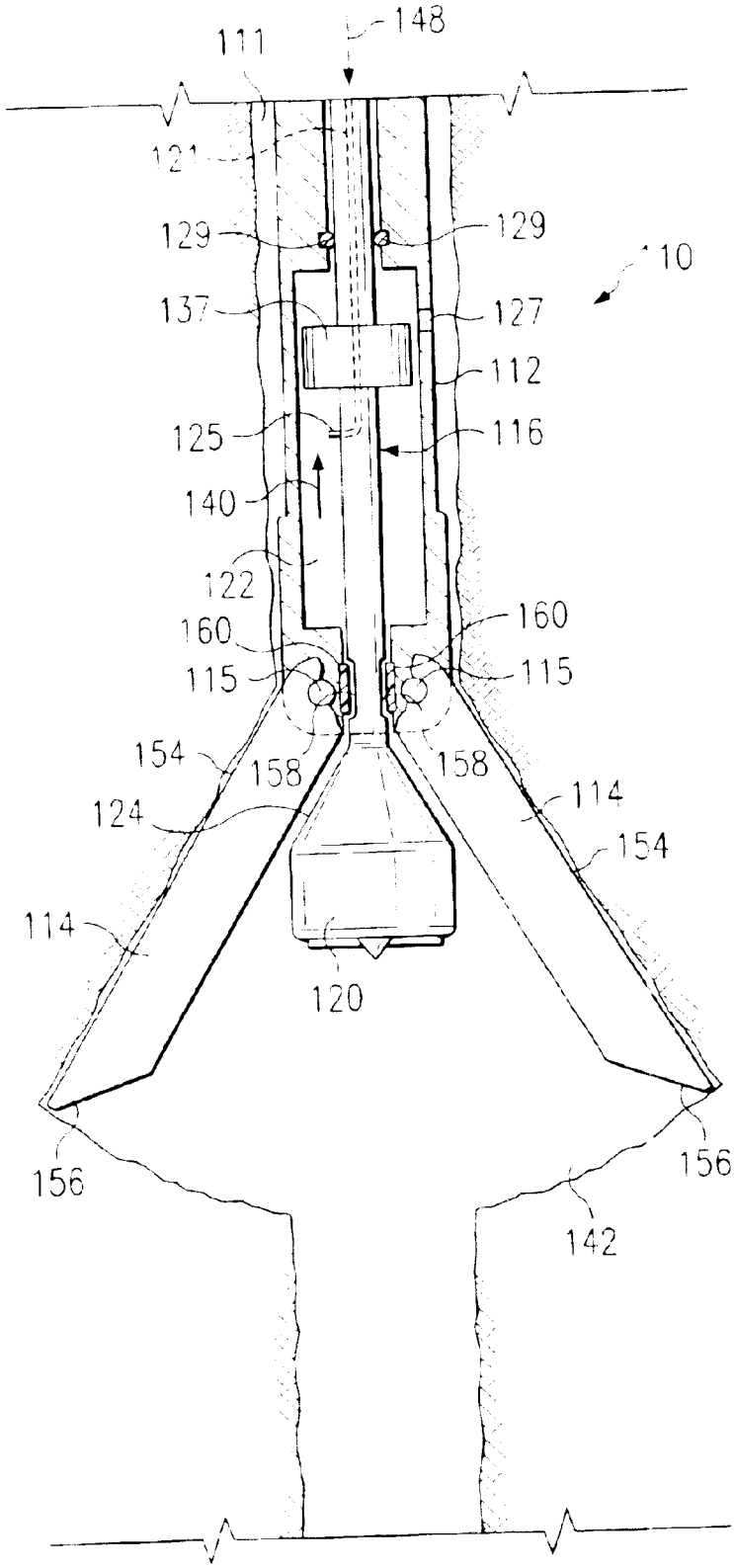
FIG. 5 is a diagram illustrating an underreamer in accordance with another embodiment of the present invention.

FIG. 5 is a diagram illustrating a portion of a wedge activated underreamer 110 disposed in a well bore 111 in accordance with another embodiment of the present invention. Underreamer 110 includes an actuator 116 slidably positioned within a housing 112. Actuator 116 includes a fluid passage 121. Fluid passage 121 includes an outlet 125 which allows fluid to exit fluid passage 121 into a pressure cavity 122 of housing 112. Pressure cavity 122 includes an exit port 127 which allows fluid to exit pressure cavity 122 into well bore 111. In particular embodiments, exit port 127 may be coupled to a vent hose in order to transport fluid exiting through exit port 127 to the surface or to another location. Actuator 116 includes an enlarged portion 120 having a beveled portion 124. Actuator 116 also includes pressure grooves 158 which allow fluid to exit pressure cavity 122 when actuator 116 is disposed in a position such that enlarged portion 120 is proximate housing 112, as described in more detail below with regards to FIGS. 6 and 7. Gaskets 160 are disposed proximate actuator 116. Underreamer 110 includes cutters 114 coupled to housing 114 via pins 115.

In operation, a pressurized fluid is passed through fluid passage 121 of actuator 116. Such disposition may occur through a drill pipe connector connected to housing 112 in a similar manner as described above with respect to underreamer 10 of FIGS. 1–3. The pressurized fluid flows through fluid passage 121 and exits the fluid passage through outlet 125 into pressure cavity 122. Inside pressure cavity 122, the pressurized fluid exerts a first axial force 140 upon an enlarged portion 137 of actuator 116. Actuator 116 is encircled by circular gaskets 129 in order to prevent pressurized fluid from flowing up out of pressure cavity 122. The exertion of first axial force 140 on enlarged portion 137 of actuator 116 causes movement of actuator 116 relative to housing 112. Such movement causes beveled portion 124 of enlarged portion 120 to contact cutters 114 causing cutters 114 to rotate about pins 115 and extend radially outward relative to housing 112, as described above. Through extension of cutters 114, underreamer 110 forms an enlarged cavity 142 as cutting surfaces 154 and 156 of cutters 114 come into contact with the surfaces of well bore 111.

Underreamer 110 is illustrated with cutters 114 in a semi-extended position relative to housing 112. Cutters 114 may move into a more fully extended position through the application of a second axial force in a similar fashion as cutters 14 of underreamer 10 illustrated in FIGS. 1–3. Underreamer 110 may be raised, lowered and rotated to further define and shape cavity 142.

Figure 6:
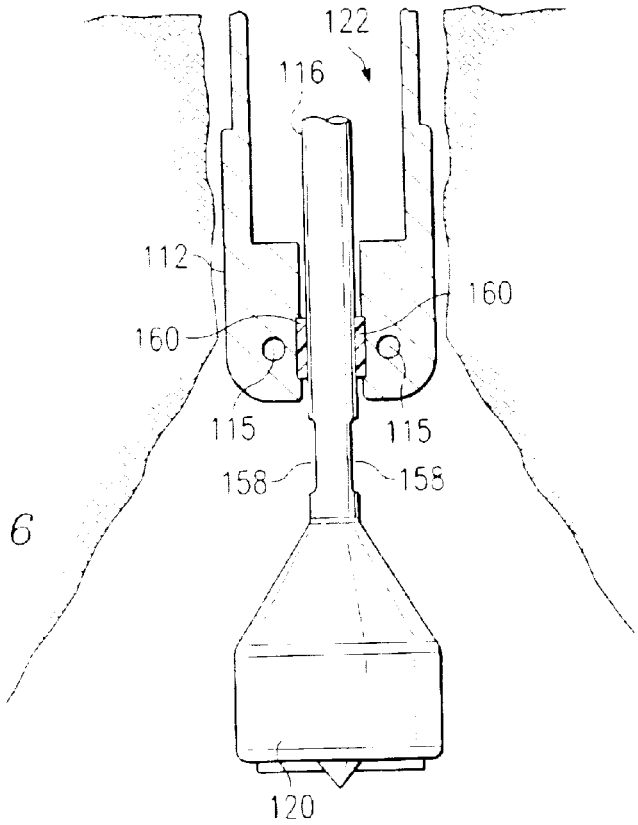
FIG. 6 is a diagram illustrating a portion of the underreamer of FIG. 5 with the actuator in a particular position.
Figure 7:
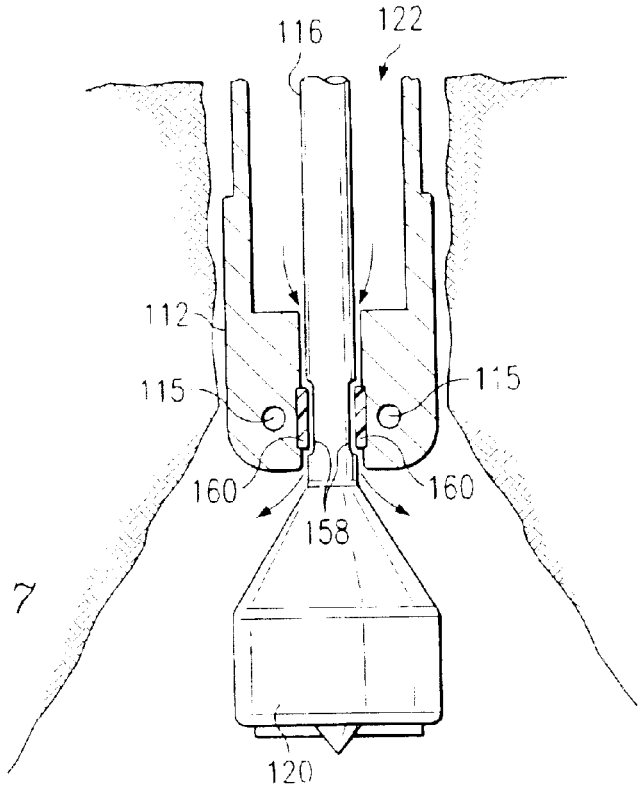
FIG. 7 is a diagram illustrating a portion of the underreamer of FIG. 5 with an enlarged portion of the actuator proximate the housing.

FIGS. 6 and 7 illustrate the manner in which pressure grooves 158 of actuator 116 of the underreamer of FIG. 5 allow the pressurized fluid to exit pressure cavity 122. FIGS. 6 and 7 illustrate only certain portions of the underreamer, including only a portion of actuator 116. The cutting blades of the underreamer are not illustrated in FIGS. 6 and 7. As illustrated in FIG. 6, when actuator 116 is disposed such that enlarged portion 120 is not proximate housing 112, gaskets 160 prevent pressurized fluid from exiting pressure cavity 122. However, when the first axial force is applied and actuator 116 slides relative to housing 112, enlarged portion 120 of actuator 116 will eventually become proximate housing 112 as illustrated in FIG. 7. When enlarged portion 120 is proximate housing 112, pressurized fluid in pressure cavity 122 may exit the pressure cavity by flowing through pressure grooves 158 of actuator 116 in the general direction illustrated by the arrows in FIG. 7. Pressure grooves 158 may enable an operator of the underreamer to determine when enlarged portion 120 is proximate housing 112 because of the decrease in pressure when the pressurized fluid exits pressure cavity 122 through pressure grooves 158. Pressure grooves may be utilized in actuators of various embodiments of the present invention, including the underreamer illustrated in FIGS. 1–4.

Figure 8:
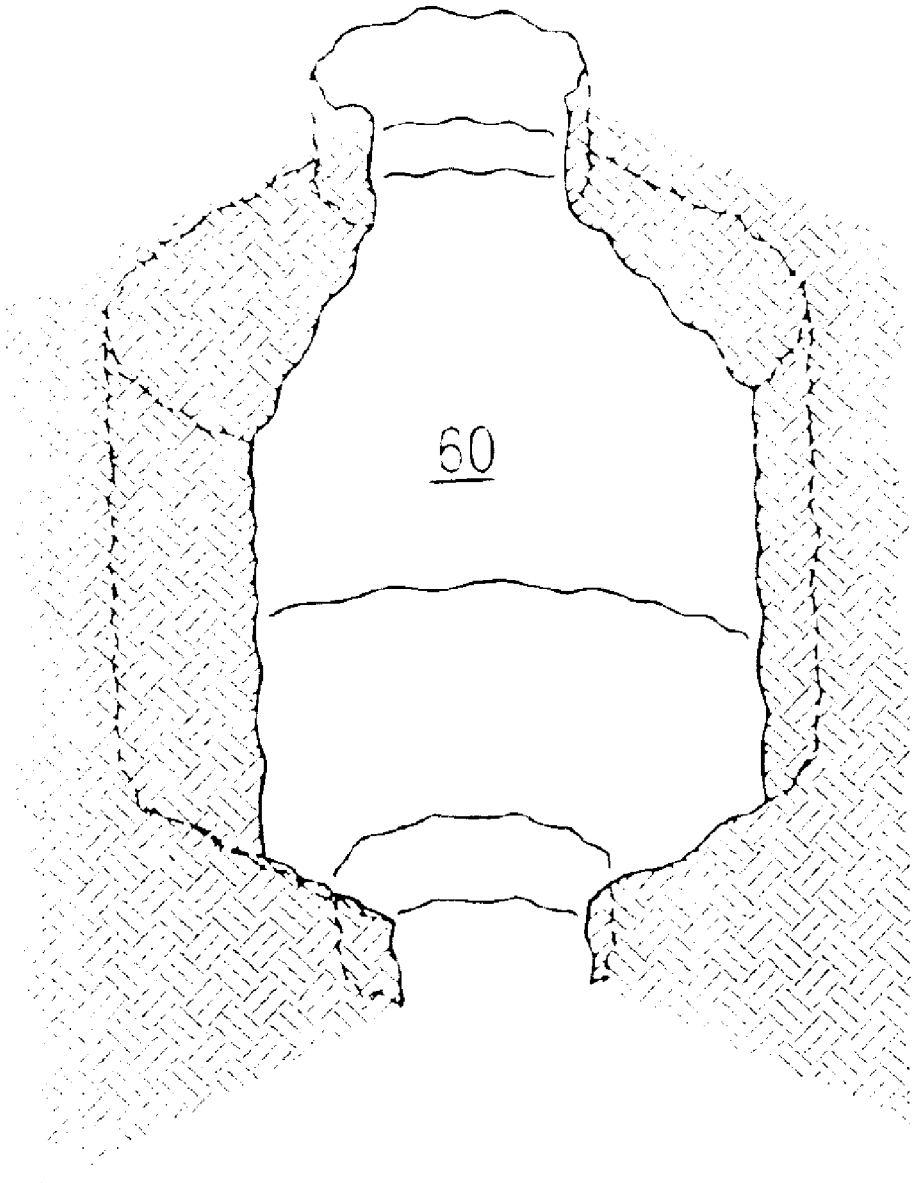
FIG. 8 is an isometric diagram illustrating a cylindrical cavity formed using an underreamer in accordance with an embodiment of the present invention.

FIG. 8 is an isometric diagram illustrating a cylindrical cavity 60 formed using an underreamer in accordance with an embodiment of the present invention. Cylindrical cavity 60 has a generally cylindrical shape and may be formed by raising and/or lowering the underreamer in the well bore and by rotating the underreamer.

Although the present invention has been described in detail, various changes and modifications may be suggested to one skilled in the art. It is intended that the present invention encompass such changes and modifications as falling within the scope of the appended claims.

What is claimed is:

1. An underreamer for forming cavity from within a well bore, comprising:

a housing adapted to be disposed within the well bore;

at least one cutter, each cutter having a first end and a second end, the first end of each cutter pivotally coupled to the housing;

an actuator positioned in the housing, the actuator having a first end and a second end;

an enlarged portion of the actuator proximate the second end of the actuator;

wherein a first force applied to the actuator is operable to move the actuator relative to the housing causing the enlarged portion to contact each cutter and extend the second end of each cutter radially outward relative to the housing from a retracted position to a first position; and wherein an axial force applied to the underreamer is operable to further extend the second end of each cutter radially outward relative to the housing from the first position to a second position.

2. The underreamer of claim 1, wherein each cutter is approximately perpendicular to a longitudinal axis of the housing when each cutter is in the second position.

3. The underreamer of claim 1, wherein the axial force is applied in substantially the opposite direction as the first force.

4. The underreamer of claim 1, wherein the first force comprises hydraulic pressure from a pressurized fluid.

5. The underreamer of claim 1, wherein the actuator comprises a piston having a first end and a second end, the first end of the piston slidably positioned in a hydraulic cylinder of the housing, wherein the piston is coupled to the enlarged portion.

6. The underreamer of claim 1, wherein the formed cavity comprises a generally cylindrical shape defined when the underreamer is rotated.

7. The underreamer of claim 1, wherein the formed cavity comprises a generally rectangular prism shape.

8. The underreamer of claim 1, wherein at least one cutter comprises a replaceable tip at its second end.

9. The underreamer of claim 1, wherein the enlarged portion comprises a beveled portion.

10. An underreamer for forming a cavity from within a well bore, comprising:

a housing adapted to be disposed within the well bore;

at least one cutter, each cutter having a first end and a second end, the first end of each cutter pivotally coupled to the housing;

an actuator positioned in the housing, the actuator having a first end and a second end;

an enlarged portion of the actuator proximate the second end of the actuator;

wherein a first force applied to the actuator is operable to move the actuator relative to the housing causing the enlarged portion to contact each cutter and extend the second end of each cutter radially outward relative to the housing from a retracted position to a first position;

wherein the first force comprises hydraulic pressure from a pressurized fluid; and wherein the actuator comprises a pressure groove, the pressure groove configured to allow the pressurized fluid to exit a pressure cavity of the housing when the enlarged portion of the actuator is proximate the housing.

11. An underreamer for forming a cavity from within a well bore, comprising:

a housing adapted to be disposed within the well bore;

at least one cutter, each cutter having a first end and a second end, the first end of each cutter pivotally coupled to the housing;

an actuator positioned in the housing, the actuator having a first end and a second end;

an enlarged portion of the actuator proximate the second end of the actuator;

wherein a first force applied to the actuator is operable to move the actuator relative to the housing causing the enlarged portion to contact each cutter and extend the second end of each cutter radially outward relative to the housing from a retracted position to a first position; and wherein the actuator is operable to slide along at least one guide rail of the housing, the guide rails operable to prevent rotation of the actuator relative to the housing.

12. A method for forming a cavity from within a well bore, comprising:

providing an underreamer within the well bore, the underreamer having a housing and an actuator, the actuator having a first end and a second end and an enlarged portion proximate the second end, wherein the actuator is positioned in the housing, the underreamer further having at least one cutter, each cutter having a first end and a second end, the first end of each cutter pivotally coupled to the housing;

applying a first force to the actuator, causing the enlarged portion to contact each cutter;

extending each cutter radially outward relative to the housing from a retracted position to a first position to form the cavity, wherein the extension is in response to the contact of each cutter by the enlarged portion and movement of the actuator from the applied first force; and applying an axial force to the underreamer to cause each cutter to contact a surface of the well bore and further extend the second end of each cutter radially outward relative to the housing from the first position to a second position.

13. The method of claim 12, further comprising rotating the underreamer within the well bore to form the cavity.

14. The method of claim 13, wherein the formed cavity comprises a generally cylindrical shape.

15. The method of claim 12, wherein each cutter is approximately perpendicular to a longitudinal axis of the housing when each cutter is in the second position.

16. The method of claim 12, wherein the axial force is applied in substantially the opposite direction as the first force.

17. The method of claim 12, wherein the first force comprises hydraulic pressure from a pressurized fluid.

18. The method of claim 12, wherein the actuator comprises a piston having a first end and a second end, the first end of the piston slidably positioned in a hydraulic cylinder of the housing, wherein the piston is coupled to the enlarged portion.

19. The method of claim 12, wherein the formed cavity comprises a generally rectangular prism shape.

20. The method of claim 12, wherein the enlarged portion comprises a beveled portion.

21. A method for forming a cavity from within a well bore, comprising:

providing an underreamer within the well bore, the underreamer having a housing and an actuator, the actuator having a first end and a second end and an enlarged portion proximate the second end, wherein the actuator is positioned in the housing, the underreamer further having at least one cutter, each cutter having a first end and a second end, the first end of each cutter pivotally coupled to the housing;

applying a first force to the actuator, causing the enlarged portion to contact each cutter;

extending each cutter radially outward relative to the housing from a retracted position to a first position to form the cavity, wherein the extension is in response to the contact of each cutter by the enlarged portion and movement of the actuator from the applied first force;

wherein the first force comprises hydraulic pressure from a pressurized fluid; and wherein the actuator comprises a pressure groove, the pressure groove configured to allow the pressurized fluid to exit a pressure cavity of the housing when the enlarged portion of the actuator is proximate the housing.

22. A method for forming a cavity from within a well bore, comprising:

providing an underreamer within the well bore, the underreamer having a housing and an actuator, the actuator having a first end and a second end and an enlarged portion proximate the second end, wherein the actuator is positioned in the housing, the underreamer further having at least one cutter, each cutter having a first end and a second end, the first end of each cutter pivotally coupled to the housing;

applying a first force to the actuator, causing the enlarged portion to contact each cutter;

extending each cutter radially outward relative to the housing from a retracted position to a first position to form the cavity, wherein the extension is in response to the contact of each cutter by the enlarged portion and movement of the actuator from the applied first force; and wherein the actuator is operable to slide along at least one guide rail of the housing, the guide rails operable to prevent rotation of the actuator relative to the housing.

* * * * *